US009660424B2

(12) United States Patent
Doi et al.

(10) Patent No.: US 9,660,424 B2
(45) Date of Patent: May 23, 2017

(54) SPARK PLUG

(71) Applicant: DENSO CORPORATION, Kariya, Aichi-pref. (JP)

(72) Inventors: Kaori Doi, Kariya (JP); Masamichi Shibata, Kariya (JP); Yuuto Tamei, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/301,601

(22) PCT Filed: Apr. 1, 2015

(86) PCT No.: PCT/JP2015/060336

§ 371 (c)(1),
(2) Date: Oct. 3, 2016

(87) PCT Pub. No.: WO2015/156185

PCT Pub. Date: Oct. 15, 2015

(65) Prior Publication Data

US 2017/0025821 A1 Jan. 26, 2017

(30) Foreign Application Priority Data

Apr. 10, 2014 (JP) ..... 2014-080651

(51) Int. Cl.
*H01T 13/20* (2006.01)

(52) U.S. Cl.
CPC ..... *H01T 13/20* (2013.01)

(58) Field of Classification Search
CPC ..... H01T 13/20
See application file for complete search history.

(56) References Cited

U.S. PATENT DOCUMENTS 4,439,708 A * 3/1984 Hattori ..... H01T 13/39 313/140
5,821,675 A * 10/1998 Suzuki ..... H01T 13/462 313/123
2007/0052336 A1* 3/2007 Liao ..... H01T 13/20 313/141
2009/0127997 A1 5/2009 Kameda et al.
(Continued)

FOREIGN PATENT DOCUMENTS

JP 2009-199724 9/2009
JP 2010-073313 4/2010

*Primary Examiner* — Donald Raleigh
(74) *Attorney, Agent, or Firm* — Nixon & Vanderhye P.C.

(57) ABSTRACT

A spark plug 1 has a center electrode 4 and a ground electrode 5 opposed to each other and causes a spark discharge to occur through application of a voltage between the center electrode 4 and the ground electrode 5 . Moreover, the center electrode 4 has a columnar main chip 10 provided at a distal end thereof by welding via a fusion portion 12 and an annular auxiliary chip 11 surrounding the fusion portion 12. Consequently, when a spark discharge occurring from the center electrode 4 is blown to the downstream side by the influence of a gas flow in a cylinder of an internal combustion engine, it is possible to suppress a cathode point from being formed in the fusion portion 12 since the fusion portion 12 is surrounded and thus protected by the auxiliary chip 11. As a result, it is possible to suppress wear of the center electrode 4, thereby extending the service life of the spark plug 1.

3 Claims, 4 Drawing Sheets

(56) References Cited

U.S. PATENT DOCUMENTS

| | | | | |
|---|---|---|---|---|
| 2009/0134764 | A1 | 5/2009 | Kameda et al. | |
| 2009/0140624 | A1 | 6/2009 | Kameda et al. | |
| 2010/0264803 | A1 | 10/2010 | Nunome et al. | |
| 2010/0264804 | A1 | 10/2010 | Kameda et al. | |
| 2010/0275870 | A1 | 11/2010 | Kameda et al. | |
| 2010/0283373 | A1 | 11/2010 | Kameda | |
| 2013/0009535 | A1* | 1/2013 | Mori | H01T 13/20 313/141 |

* cited by examiner

SPARK PLUG

This application is the U.S. national phase of International Application No. PCT/JP2015/060336filed 1 Apr. 2015, which designated the U.S. and claims priority to JP Patent Application No. 2014-080651 filed 10 Apr. 2014, the entire contents of each of which are hereby incorporated by reference.

TECHNICAL FIELD

The present invention relates to spark plugs that cause a spark discharge to occur in, for example, a cylinder of an internal combustion engine, thereby igniting an air-fuel mixture.

BACKGROUND ART

Conventionally, there have been known spark plugs that have a center electrode and a ground electrode opposed to each other, and cause a spark discharge to occur through application of a voltage between the center and ground electrodes. Moreover, it has always been pursued to extend the service lives of the spark plugs.

In particular, in cases where the center electrode is provided by welding, there exists in the center electrode a fusion portion that contains oxide layers to a great extent. Therefore, as shown in FIG. 4, when a spark discharge occurring from the center electrode is blown to the downstream side by the influence of a gas flow (i.e., a flow of an air-fuel mixture) in a cylinder of an internal combustion engine, the fusion portion is worn down by formation of a cathode point of the spark discharge in the fusion portion, resulting in an early wear of the center electrode.

In addition, as a measure of extending the service lives of the spark plugs, there has been considered a configuration where the dimensions of a noble metal chip provided in the center electrode by welding are increased (see, for example, Patent Document 1). However, in the case of employing this configuration, the cost is increased; in addition, since the fusion portion still exists in the center electrode, the problem of wear of the fusion portion remains unsolved.

Moreover, there has also been known a configuration where both a columnar main chip and an annular auxiliary chip surrounding the main chip are provided in a ground electrode (see, for example, Patent Documents 2 and 3). However, this configuration has been developed for preventing an unintended multiple discharge from occurring due to the blow-out of sparks with increase in the gas flow speed and thereby suppressing wear of the ground electrode. That is, this configuration has been developed not for suppressing wear of the center electrode.

PRIOR ART LITERATURE

Patent Literature

[PATENT DOCUMENT 1] Japanese Patent Application Publication No. JP2009187840A

[PATENT DOCUMENT 2] Japanese Patent Application Publication No. JP2009199724A

[PATENT DOCUMENT 3] Japanese Patent No. JP5057073B2

SUMMARY OF THE INVENTION

Problems to be Solved by the Invention

The present invention has been made in view of the above problems, and aims to suppress wear of a center electrode and thereby extend the service life of a spark plug.

Means for Solving the Problems

According to the present invention, a spark plug has a center electrode and a ground electrode opposed to each other and causes a spark discharge to occur through application of a voltage between the center electrode and the ground electrode. Moreover, the center electrode has a columnar main chip provided at a distal end thereof by welding via a fusion portion and an annular auxiliary chip surrounding the fusion portion.

Consequently, when a spark discharge occurring from the center electrode is blown to the downstream side by the influence of a gas flow in a cylinder of an internal combustion engine, it is possible to suppress a cathode point from being formed in the fusion portion since the fusion portion is surrounded and thus protected by the auxiliary chip. As a result, it is possible to suppress wear of the center electrode, thereby extending the service life of the spark plug.

According to an embodiment of the present invention, a distal end of the main chip is arranged to protrude from a distal end of the auxiliary chip toward the ground electrode in an axial direction of the spark plug.

Consequently, the discharge gap between the center electrode and the ground electrode becomes smaller between the main chip and the ground electrode than between the auxiliary chip and the ground electrode. Therefore, during the occurrence of a spark discharge, a capacitive discharge first occurs between the main chip and the ground electrode. Then, an inductive discharge following the capacitive discharge is moved, under the influence of the gas flow, to occur between the auxiliary chip and the ground electrode; the auxiliary chip has the same electrical potential as the main chip.

Thus, a cathode point of the capacitive discharge is mainly formed in the main chip, whereas a cathode point of the inductive discharge is mainly formed in the auxiliary chip. That is, in the center electrode, the part forming the cathode point of the capacitive discharge is separated from the part forming the cathode point of the inductive discharge. As a result, it is possible to suppress wear of the center electrode, thereby extending the service life of the spark plug.

EMBODIMENTS FOR CARRYING OUT THE INVENTION

Figure 1:
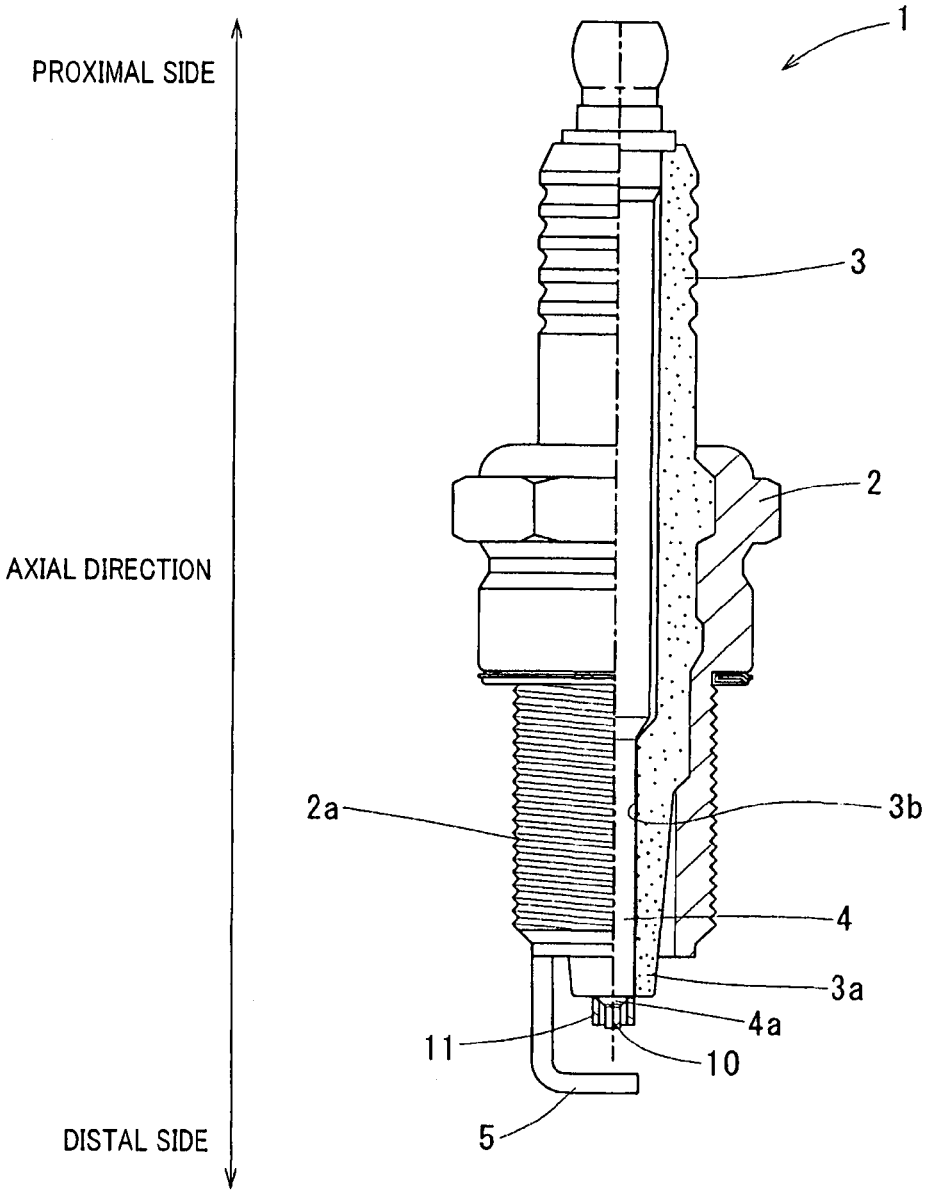
FIG. 1 is a schematic view of a spark plug according to an embodiment.

Hereinafter, a spark plug 1 according to an embodiment of the present invention will be described with reference to the drawings.

The spark plug 1 is designed to cause a spark discharge to occur in, for example, a cylinder of an internal combustion engine, thereby igniting an air-fuel mixture. The spark plug 1 includes a metal shell 2, an insulator 3, a center electrode 4 and a ground electrode 5, each of which will be described in detail hereinafter.

As shown in FIG. 1, the spark plug 1 has the metal shell 2 that is cylindrical in shape and made of carbon steel or the like. The metal shell 2 has a threaded portion 2 for fixing the spark plug 1 to a housing (not shown) of the internal combustion engine.

Inside the metal shell 2, there is fixed the insulator 3 that is formed of an alumina ($Al_2O_3$) ceramic fired body. A distal end portion 3*a* of the insulator 3 is located so as to be exposed from the metal shell 2 to the outside.

The center electrode 4 is fixed in an axial bore 3*b* that is formed in the insulator 3 so as to extend in an axial direction of the spark plug 1. The center electrode 4 is insulatively held by the metal shell 2 via the insulator 3.

Moreover, a distal end portion 4*a* of the center electrode 4 is located so as to be exposed from the distal end 3*a* of the insulator 3 to the outside. On the other hand, a main body 4*b* of the center electrode 4 is received in the axial bore 3*b* of the insulator 3.

In addition, the center electrode 4 is cylindrical in shape and made of a highly heat conductive metal material such as Cu as the core material and a highly heat-resistant, corrosion-resistant metal material such as a Ni-based alloy as the cladding material.

The ground electrode 5 has a bent portion formed therein so that the ground electrode 5 is substantially L-shaped. The ground electrode 5 is fixed, by welding, to one end of the metal shell 2 so as to face the distal end portion 4*a* of the center electrode 4 through a discharge gap formed therebetween.

In addition, the ground electrode 5 is also made of a highly heat conductive metal material such as Cu as the core material and a highly heat-resistant, corrosion-resistant metal material such as a Ni-based alloy as the cladding material.

The spark plug 1 ignites the air-fuel mixture by causing a spark discharge to occur in the discharge gap through application of a high voltage between the center electrode 4 and the ground electrode 5.

Figure 2A:
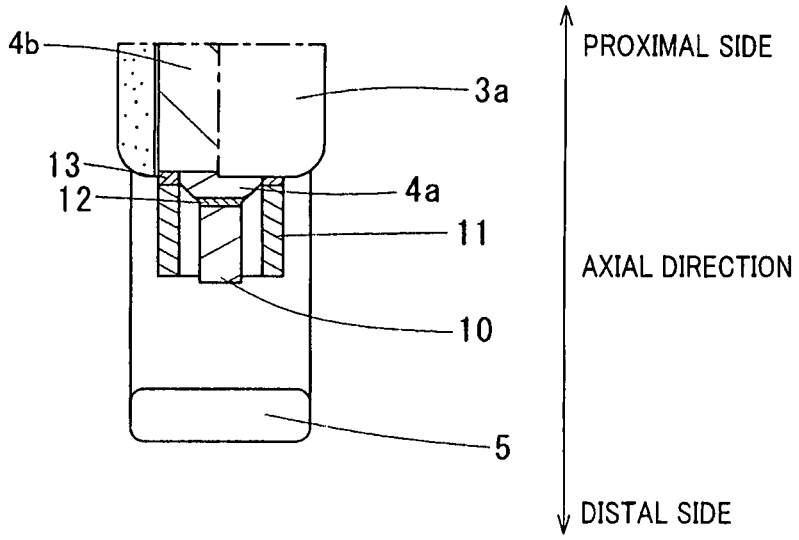
FIG. 2A is a front view of part of the spark plug according to the embodiment.
Figure 2B:
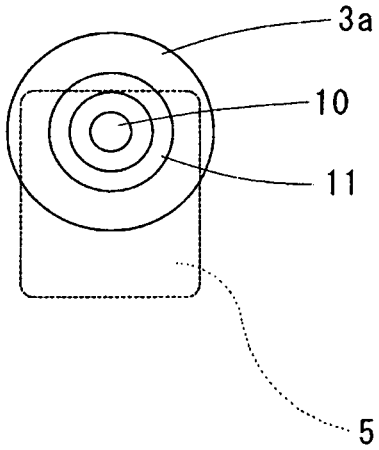
FIG. 2B is a bottom view of the part of the spark plug according to the embodiment.

In the present embodiment, as shown in FIGS. 2A-2B, the center electrode 4 has a cylindrical main chip 10 provided at its distal end and an annular auxiliary chip 11 provided so as to surround the main chip 10.

Specifically, the main chip 10 is joined to the distal end portion 4*a* of the center electrode 4 by laser welding or the like. Between the main chip 10 and the distal end portion 4*a* of the center electrode 4, there is formed a fusion portion 12. On the other hand, the auxiliary chip 11 is joined to the main body 4*b* of the center electrode 4 by laser welding or the like. Between the auxiliary chip 11 and the main body 4*b* of the center electrode 4, there is formed an annular fusion portion 13. Moreover, the fusion portion 12 is surrounded by the auxiliary chip 11, and both electrical and thermal conductions between the main chip 10 and the auxiliary chip 11 are secured.

Moreover, a distal end of the main chip 10 protrudes from a distal end of the auxiliary chip 11 toward the ground electrode 5 in the axial direction of the spark plug 1. The annular fusion portion 13 is located proximalward in the axial direction from the fusion portion 12.

In addition, each of the main chip 10 and the auxiliary chip 11 is made of a noble metal such as an iridium (Ir) alloy.

As described above, in the spark plug 1 according to the present embodiment, the center electrode 4 has the cylindrical main chip 10 provided at the distal end thereof by laser welding or the like via the fusion portion 12 and the annular auxiliary chip 11 surrounding the fusion portion 12.

Moreover, the distal end of the main chip 10 protrudes from the distal end of the auxiliary chip 11 toward the ground electrode 5 in the axial direction of the spark plug 1, and the annular fusion portion 13 is located proximalward in the axial direction from the fusion portion 12.

Figure 3A:
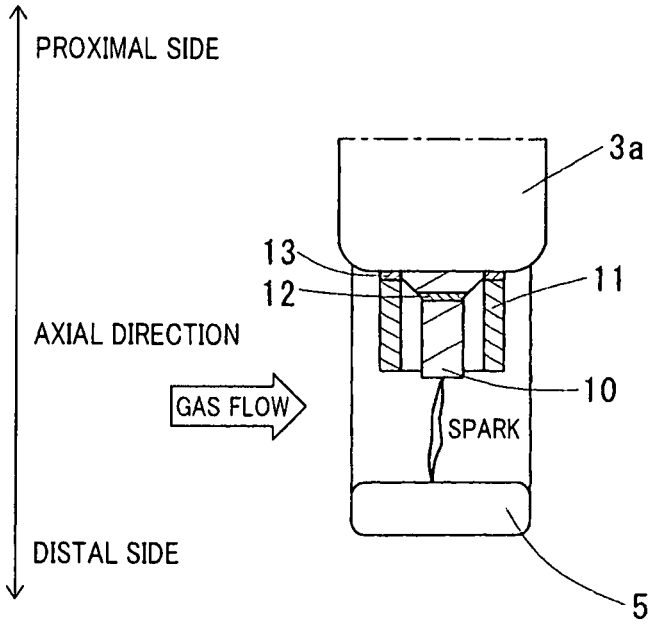
FIG. 3A is a schematic view illustrating, together with FIGS. 3B and 3C, a spark discharge in the spark plug according to the embodiment.

Consequently, the discharge gap between the center electrode 4 and the ground electrode 5 becomes smaller between the main chip 10 and the ground electrode 5 than between the auxiliary chip 11 and the ground electrode 5. Therefore, as shown in FIG. 3A, during the occurrence of a spark discharge, a capacitive discharge first occurs between the main chip 10 and the ground electrode 5.

Figure 3B:
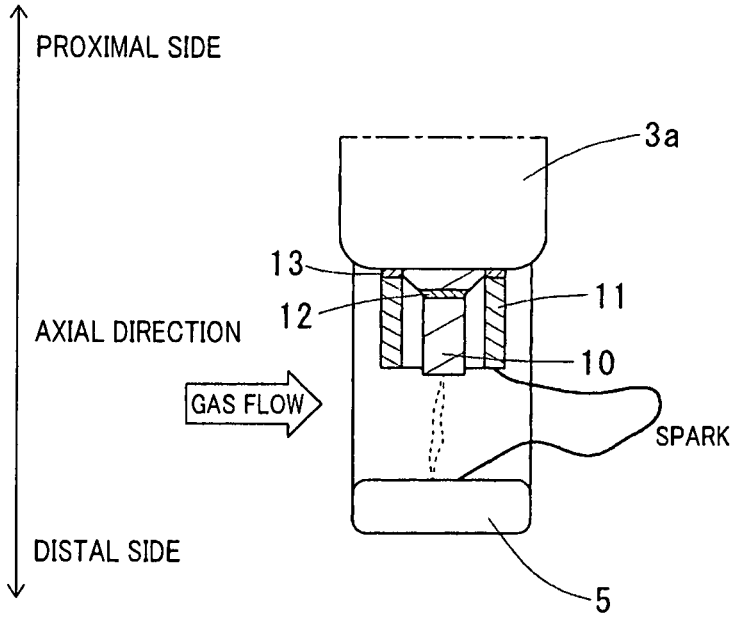
FIG. 3B is a schematic view illustrating, together with FIGS. 3A and 3C, the spark discharge in the spark plug according to the embodiment.

Then, as shown in FIG. 3B, an inductive discharge following the capacitive discharge is moved, under the influence of the gas flow, to occur between the auxiliary chip 11 and the ground electrode 5; the auxiliary chip 11 has the same electrical potential as the main chip 10. However, since the fusion portion 12 is surrounded and thus protected by the auxiliary chip 11, it is possible to suppress a cathode point from being formed in the fusion portion 12.

Moreover, a cathode point of the capacitive discharge is mainly formed in the main chip 10, whereas a cathode point of the inductive discharge is mainly formed in the auxiliary chip 11. That is, in the center electrode 4, the part forming the cathode point of the capacitive discharge is separated from the part forming the cathode point of the inductive discharge.

As a result of the above, it is possible to suppress wear of the center electrode 4, thereby extending the service life of the spark plug 1.

In addition, since wear of the main chip 10 is suppressed, it is possible to suppress the discharge gap between the main chip 10 and the ground electrode 5 from being expanded; thus it is possible to suppress a required voltage for causing the spark discharge to occur from being increased.

Figure 3C:
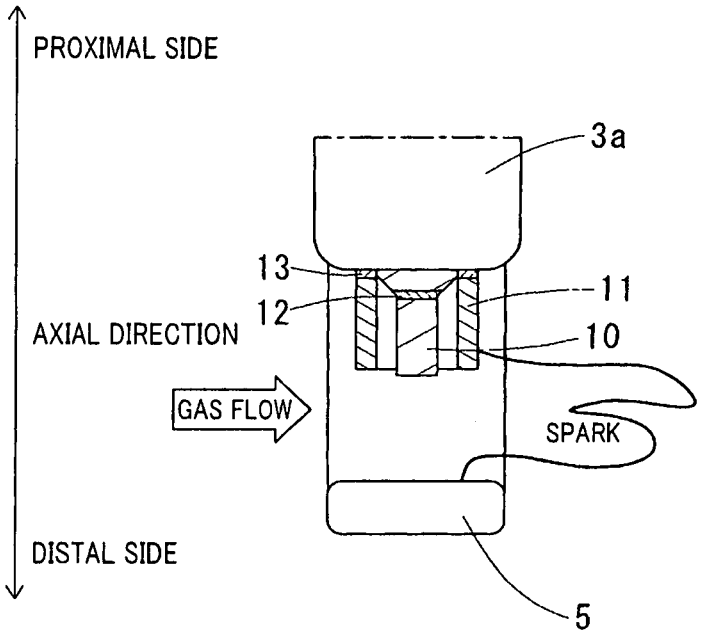
FIG. 3C is a schematic view illustrating, together with FIGS. 3A and 3B, the spark discharge in the spark plug according to the embodiment.
Figure 4:
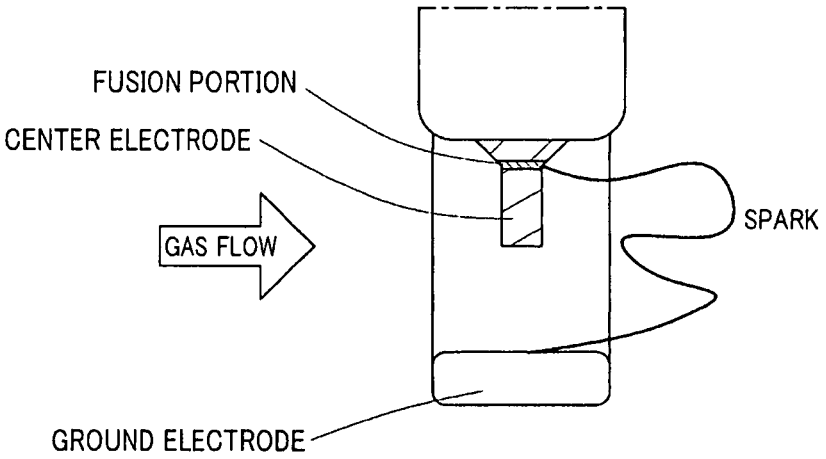
FIG. 4 is a schematic view illustrating a spark discharge in a conventional spark plug.

Moreover, when the spark discharge is further blown by the influence of the gas flow to the downstream side, a cathode point is formed on an outer circumferential surface of the auxiliary chip 11 as shown in FIG. 3C. However, even in such a case, since the annular fusion portion 13 is located proximalward in the axial direction from the fusion portion 12, it is possible to keep the distance between the annular fusion portion 13 and the ground electrode 5 long; thus it is possible to suppress the risk of a cathode point being formed in the annular fusion portion 13.

Furthermore, since the auxiliary chip 11 is arranged so as to surround the main chip 10, it is easy to increase the area of the outer circumferential surface of the annular fusion portion 13. Therefore, even if a cathode point was formed in the annular fusion portion 13, it would be possible to decentralize the cathode point-forming part; thus it would be possible to suppress wear of the annular fusion portion 13, thereby extending the service life of the spark plug 1.

DESCRIPTION OF REFERENCE SIGNS

1: spark plug
4: center electrode
5: ground electrode
10: main chip
11: auxiliary chip
12: fusion portion
13: annular fusion portion

The invention claimed is:

1. A spark plug having a center electrode and a ground electrode opposed to each other and causing a spark discharge to occur through application of a voltage between the center electrode and the ground electrode, wherein the center electrode has a columnar main chip provided at a distal end thereof by welding via a fusion portion and an annular auxiliary chip surrounding the fusion portion.

2. The spark plug as set forth in claim 1, wherein a distal end of the main chip is arranged to protrude from a distal end of the auxiliary chip toward the ground electrode in an axial direction of the spark plug.

3. The spark plug as set forth in claim 1, wherein the auxiliary chip is provided at a main body of the center electrode by welding via an annular fusion portion, and the annular fusion portion is located proximalward in the axial direction of the spark plug from the fusion portion.

* * * * *